United States Patent [19]

Johnson et al.

[11] Patent Number: 5,056,392

[45] **Date of Patent: * Oct. 15, 1991**

[54] PUNCH ASSEMBLY

[75] Inventors: Gary E. Johnson; John T. Schneider, both of Ramsey; Nils E. Sundquist, Plymouth, all of Minn.

[73] Assignee: Mate Punch & Die Co., Anoka, Minn.

[ * ] Notice: The portion of the term of this patent subsequent to Feb. 5, 2008 has been disclaimed.

[21] Appl. No.: 585,008

[22] Filed: Sep. 18, 1990

Related U.S. Application Data

[63] Continuation of Ser. No. 233,735, Aug. 19, 1988, Pat. No. 4,989,484.

[51] Int. Cl.[5] ..... B26D 7/08; B26F 1/14

[52] U.S. Cl. ..... 83/140; 83/169; 83/684; 83/698

[58] Field of Search ..... 83/169, 140, 143, 549, 83/552, 138, 142, 132, 133, 136, 137, 139, 684, 698

[56] References Cited

U.S. PATENT DOCUMENTS

| | | | |
|---|---|---|---|
| Re. 29,950 | 4/1979 | Bartha | 83/140 |
| 3,029,512 | 4/1962 | Saxton | 30/367 |
| 3,296,905 | 1/1967 | Killaly | 83/140 |
| 3,335,627 | 8/1967 | Smelts | 83/140 |
| 3,527,130 | 9/1970 | Konehaus | 83/454 |
| 3,670,613 | 6/1972 | Rienzi | 83/169 X |
| 3,733,944 | 5/1973 | Dietrick | 83/130 |
| 3,779,113 | 12/1973 | Jestin | 83/140 |
| 4,007,653 | 2/1977 | Cady | 83/140 |
| 4,012,975 | 3/1977 | LaLone | 83/140 |
| 4,134,319 | 1/1979 | Clark | 83/100 |
| 4,156,377 | 5/1979 | Bracewell | 83/524 |
| 4,206,667 | 6/1980 | Hirata et al. | 83/146 |
| 4,240,314 | 12/1980 | Teeslink | 83/635 |
| 4,248,111 | 2/1981 | Wilson et al. | 83/140 |
| 4,375,774 | 3/1983 | Wilson et al. | 83/140 |
| 4,428,262 | 1/1984 | Vlahek | 83/139 |
| 4,446,767 | 5/1984 | Wilson | 83/136 |
| 4,457,196 | 7/1984 | Cody | 83/140 |
| 4,738,173 | 4/1988 | Kiuchi | 83/34 |
| 4,862,783 | 9/1989 | Ernst | 83/552 |
| 4,993,294 | 2/1991 | Chun et al. | 83/140 |

OTHER PUBLICATIONS

Nova Style Turret-Product Sheet.
Nova Style Turret-Product Sheet.
Urethane Stripper Product Sheet.
Custom Molded Urethane Strippers (2 pages).
Mate Adjustable Length Punch Holders (2 pages).
Adjustable Length Punch Holders—Product Sheet.
Amads Tooling for 3½" Station—Product Sheet.

*Primary Examiner*—Frank T. Yost
*Assistant Examiner*—Kenneth E. Peterson
*Attorney, Agent, or Firm*—James V. Harmon

[57] ABSTRACT

In accordance with the present invention, a punching assembly is provided. The punch assembly preferably includes a casing or sleeve in which a punch is mounted for longitudinal sliding movement. In accordance with one feature of the invention, a stripper plate is provided adjacent the operating end of the punch. The stripper plate includes a central opening for the punch that surrounds and guides its cutting end. A retaining means is preferably provided to cover a portion of the stripper plate at times to keep the stripper within the assembly until it is to be released. The punch is provided with three longitudinally spaced apart bearing surfaces including a first bearing surface between the bore of the sleeve and a tang at the top of the punch assembly, a second bearing surface between the bore of the sleeve and a mating portion of the punch and a third bearing surface between the stripper plate and the operating end of the punch to thereby distribute loads, minimize wear on the punch and further improve operating precision. An additional feature of the inventiion concerns a punch lubrication trough and lubricating system.

7 Claims, 3 Drawing Sheets

PUNCH ASSEMBLY

This is a continuation of U.S. application Ser. No. 07/233,735 filed Aug. 19, 1988, now U.S. Pat. No. 4,989,484 issued Feb. 5, 1991.

FIELD OF THE INVENTION

The present invention relates to punching equipment used in a punch press or the like, and more particularly to a punching device of the type that has a punch mounted for sliding movement within a sleeve or housing.

BACKGROUND OF THE INVENTION

There has existed the need for a high speed punching assembly to be used with the higher speed turret punch presses. High operating speeds and the increased use of standard tooling have created problems for prior punching assemblies, particularly when they are used to notch or nibble a workpiece. In a notching or nibbling operation in which a large area needs to be removed, a punch of a smaller size than the area to be removed can be used to nibble the material out in small bites. This creates a substantial lateral pressure on the punch since the punch is being used on only one or two sides. In the prior punching assemblies, the punch holder travels up and down in the press turret during this side loading, causing galling, seizing and bell-mouthing of the turret. It is therefore a general object to reduce this kind of wear and the expensive rework or replacement of the turret by limiting wear to the internal parts of the punching assembly.

In addition, the lubrication of previous punching assemblies has been a hit or miss proposition. This has contributed to premature damage and replacement of parts. Moreover, prior tools have had a tendency to overheat. It is therefore an object to provide a more effective means for lubricating and cooling the punching assembly, particularly the operating end of the punch.

The high speed steel from which the punch is made, while excellent in high temperature and abrasion resistance, is quite fragile and susceptible to chipping and spalling at its cutting edge. It is therefore an objective to support the punch at the working end in two dimensions, namely, by supporting it against both lateral and rotary movement.

Thus, in prior punching assemblies, wear was excessive and too much time was required to remove and replace the punch in the punch assembly. The general objectives of the invention are to reduce wear, provide finished parts of better quality, i.e., flatter sheets, less burrs, longer punch life, quicker punch changing with more reliable and trouble free operation.

In view of these and other deficiencies of the prior art, the present invention has the following more specific objectives and advantages:

(a) The provision of an improved punching assembly having a means for more quickly and easily removing and replacing the punch and stripper plate and for guiding the punch at a plurality of spaced apart points;

(b) Provision for more effectively lubricating internal parts;

(c) Provision for the above-noted features in a push-pull style punch suited for use in a pushpull type punch press or press brake; and (d) A provision that enables the stripper plate to guide the punch both laterally and about its axis for improving alignment and stability especially when notching and nibbling.

These and other more detailed specific objects of the invention will be apparent in view of the following description setting forth but a few of the various ways in which the present invention can be accomplished in view of the accompanying description which illustrates the invention by way of example.

SUMMARY OF THE INVENTION

In accordance with the present invention, a punching assembly is provided. The punch assembly preferably includes a casing or sleeve in which a punch is mounted for longitudinal sliding movement. In accordance with one feature of the invention, a stripper plate is provided adjacent the operating end of the punch. The stripper plate includes a central opening for the punch that surrounds and guides its cutting end. A retaining means is preferably provided to cover a portion of the stripper plate at times to keep the stripper within the assembly until it is released by moving the retaining element away from a locking position over the stripper. The stripper plate can be keyed to the sleeve in any known manner, e.g. by means of a key on either the stripper plate or sleeve projecting into a longitudinally extending way in the other part or even if desired by means of radially extending pins or teeth that provide a sliding fit between the sleeve and the stripper plate.

In accordance with the invention, the punch is provided with three longitudinally spaced apart bearing surfaces including a first bearing surface between the bore of the sleeve and a tang at the top of the punch assembly, a second bearing surface between the bore of the sleeve and a mating portion of the punch and a third bearing surface between the stripper plate and the operating end of the punch to thereby distribute loads, minimize wear on the punch and further improve operating precision.

In the preferred form of the invention, the punch is the push-pull type punch in which the sleeve or body of the punch is held stationary during punching. A punch retraction spring is mounted internally within the sleeve for achieving a positive stripping action.

An additional feature of the invention concerns a punch lubrication trough and lubrication system.

The invention will now be described by way of example with reference to the following figures.

THE FIGURES

DESCRIPTION OF A PREFERRED EMBODIMENT

Figures 1A, 1B, 1C, 2:
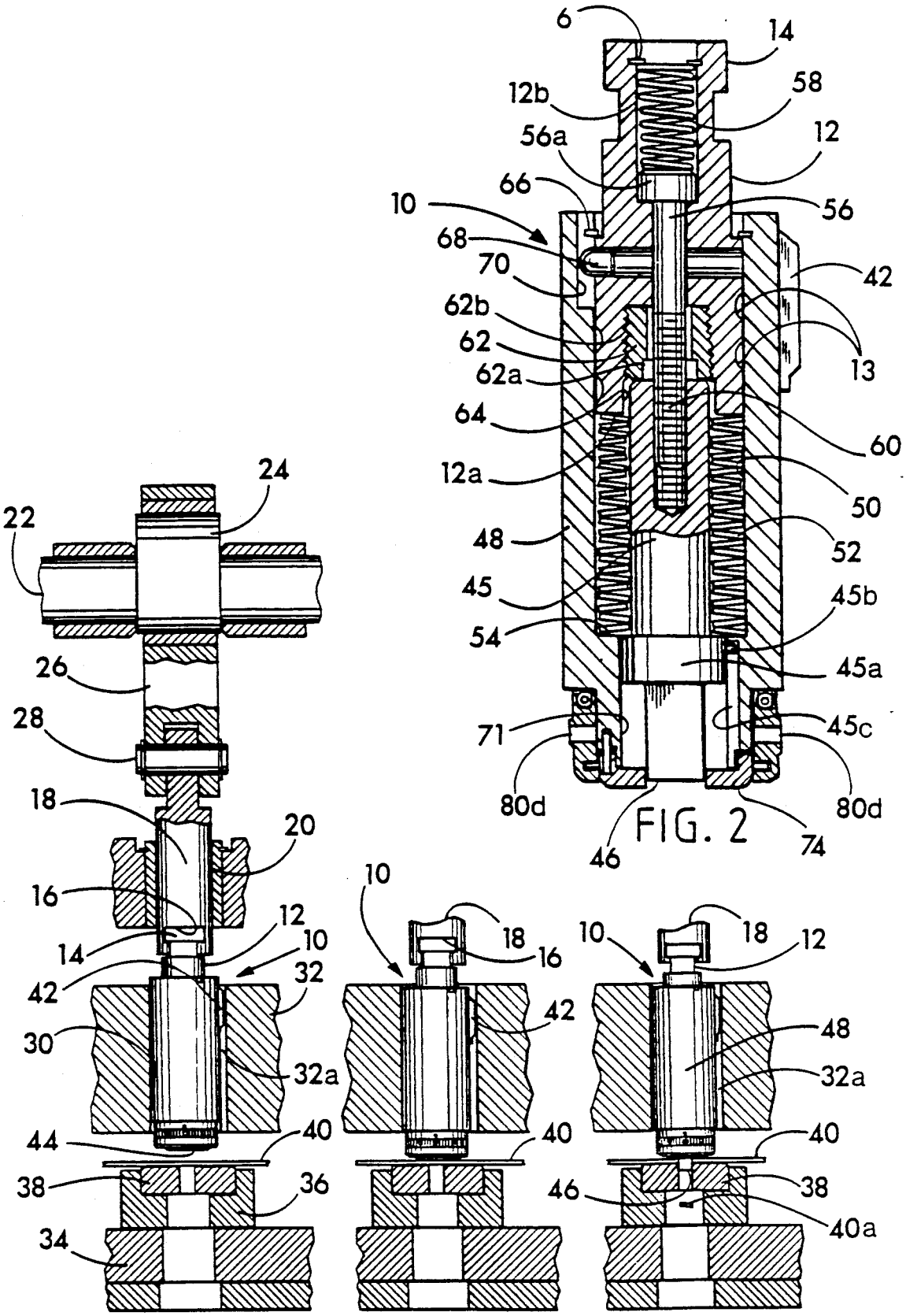
FIGS. 1A–1C are vertical sectional views of a punch assembly and associated punch press mechanism during three sequential stages of operation.
FIG. 2 is a vertical cross-sectional view of the punch assembly.
Figure 3:
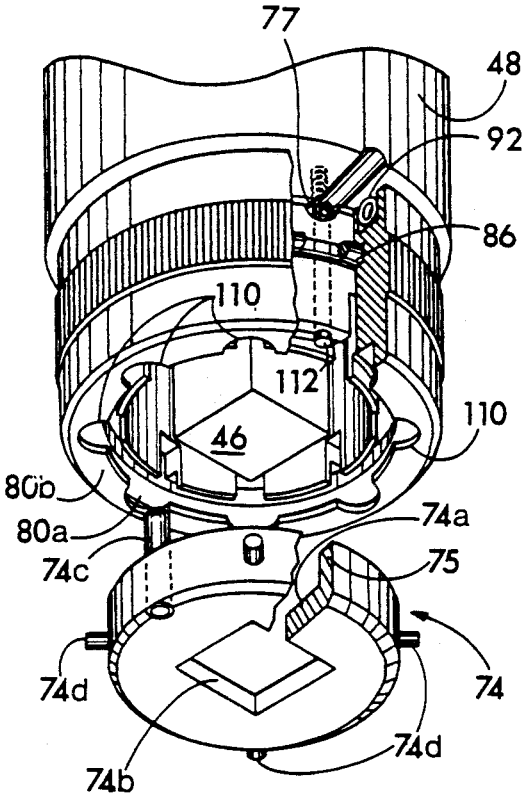
FIG. 3 is a perspective view of the lower end of the punch assembly with the stripper plate removed.

FIGS. 1A–1C and 2 which illustrate a punch assembly in accordance with the invention designated generally by the numeral 10. The punch assembly 10 includes a tang 12 having a T-shaped head 14 adapted to fit into a similarly shaped horizontally disposed slot 16 in a vertically disposed ram 18 mounted for vertical sliding movement within a vertical bearing 20. During operation, the ram is reciprocated by the rotation of a crankshaft 22 having eccentric 24 journaled for rotation within a pitman 26 that is connected to the ram 18 by means of a fulcrum pin 28. The punch assembly 10 is mounted for vertical sliding movement within a vertical bore 30 in the upper turret 32 of the punch press which also includes a lower turret 34 upon which is supported a die holder 36, die 38 and the workpiece 40. It will be seen that the upper turret 32 is provided with a vertically disposed keyway **32*a* and that the punch assembly 10 has secured to its outer surface an axially disposed, radially extending key 42 to keep the punch assembly from rotating in the bore 30, i.e., the key and keyway serve as a means for orienting the punch assembly and controlling its angular position about its center, namely, the axis of sliding of the punch within the bore 30. It should be understood that the punch press including the upper and lower turrets 32, 34, the ram 18 and the crankshaft 22** are of well-known construction and commercially available.

From the description given it can be seen that the punch assembly 10 will be held against rotation within the bore 30 by the provision of the key 42 and keyway **32*a*. The T-connection at the top of the tang 12 permits the upper and lower turrets to move simultaneously in a horizontal plane for removing the T-head 14 from the slot 16 and introducing a different but similar punch and die assembly (not shown) so that when the T-head 14 of the new punch is introduced into the slot 16**, punching can continue, usually with a punch of a different size or shape.

In the first stage of the punching operation in FIG. 1A, the punch assembly 10 is elevated so that a space exists above a workpiece 40. In the second stage, shown in FIG. 1B, the lower surface 44 of the punch assembly 10 contacts the workpiece 40. In the third stage of operation, the ram 18 continues to move downwardly as shown in FIG. 1C, forcing the operating end or point 46 of a punch 45 outwardly while the outer portion or sleeve 48 of the punch assembly 10 remains stationary. As the point 46 of the punch is extended, the portion of a workpiece **40*a* beneath the punch is expelled through the die 38**.

Refer now to FIG. 2 which illustrates the internal construction of the punch assembly 10. The punch assembly includes a cylindrical punch housing or sleeve 48 of ground and hardened steel having a central longitudinal bore 50 that encloses the punch 45 and a punch retraction spring assembly 52 which in this case comprises a stack of disc or Belville springs of annular configuration that during operation are compressed between a shoulder 54 at the bottom of the bore 50 and the lower surface **12*a* of the tang 12 for retracting the punch 45**.

The punch 45 extends through the spring assembly 52 and is secured to the tang 12 by means of a drawbolt 56 having a head **56*a* countersunk in bore 12*b* and held in place at the bottom of the bore by means of a spring, in this case a helical ejection spring 58, the top end of which is secured within the countersunk bore 12*b* by means of a spring clip 6. The ejection spring 58 yieldably biases the drawbolt 56 downwardly and ejects the punch and stripper when released as will be further described below. The lower end of the drawbolt 56 is screw-threaded at 60 into the punch 45. Within the lower end of the tang 12 above the punch 45 for the purpose of adjusting the extension of the punch point 46, is a punch length adjustment platen or screw 62 having an allen wrench opening 62*a* at its lower end allowing it to be threaded up or down in the tang 12 by being screw-threaded at 62*b* within a bore 64 at the lower end of the tang 12. The tang itself is held in place at the top by means of a retaining ring 66 and is prevented from rotating within the bore 50 by being keyed therein, as for example by means of laterally extending key 68 extending into a longitudinally extending keyway 70**.

An enlarged flange **45*a* near the lower end of the punch 45 is slidably received within a bore 71 at the lower end of the sleeve and can, if desired, be provided with a radially extending key or pin 45*b* that slides in a longitudinally extending keyway 45*c***.

Refer now to FIGS. 3–6. During operation, the operating end of a punch or punch point 46 is guided by means of a removable stripper plate 74. The stripper plate 74 is circular and, in this case, cup-shaped having an internal central recess **74*a* surrounding a punch opening 74*b* of the proper size to fit the punch point 46. The stripper plate 74 is provided with at least one extension but in this case four extensions in the form of laterally projecting pins 74*d* are used. In addition, an orientation means is provided comprising a longitudinally extending orientation pin 74*c***.

Figure 4:
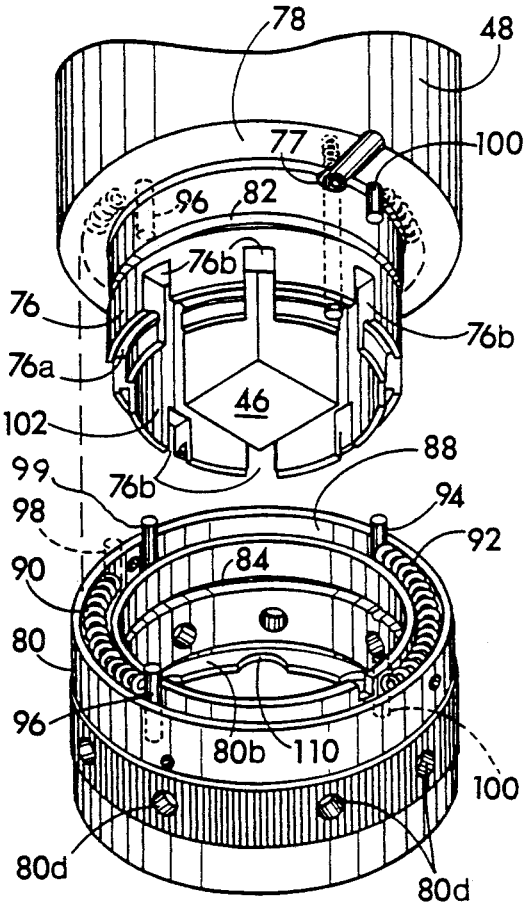
FIG. 4 is a perspective view of the lower end of the punch showing the locking ring as it appears when removed from the end of the punch sleeve.

As seen in FIG. 4, the lower end of the sleeve 48 is provided with a circular boss 76 surrounded by a downwardly facing shoulder 78 to receive a stripper plate retaining member or locking ring 80. Aligned, circumferentially extending grooves 82 and 84 are provided on the boss and on the locking ring 80 to receive a snap-ring 86 (FIG. 3) for holding the locking ring 80 in place after assembly. The locking ring 80 is provided with an upwardly facing circumferentially extending groove 88 to receive positioning springs 90 and 92 located within the groove 88 and positioned between a pair of diametrically opposed pins 94, 96 affixed to the locking ring 80 and a second pair of diametrically opposed pins 98 and 100 that are secured to the sleeve 48 and which for convenience of illustration are depicted by dotted lines in FIG. 4 as they would appear after the locking ring 80 has been mounted on the boss 76. Pin 99 is mounted in the locking ring 80 at a point spaced circumferentially from pin 98 so that as springs 90, 92 extend fully pin 99 will strike pin 98 and act as a stop to hold the locking ring 80 in the locked position.

As shown in FIG. 4, the boss 76 is hollow and is provided with a central bore 71 within which the flange **45*a* slides during operation. The boss 76 is also provided with an annular recess 76*a* at its lower end to receive an upwardly extending rim 75 at the edge of the stripper plate 74. As shown in FIG. 4, the boss 76 is also provided with a plurality of circumferentially spaced radial slots 76***b*, in this case there being four diametrically opposed pairs arranged at equal intervals of just the proper size to receive the longitudinally extending orientation pin 74*c* shown in FIG. 3. In this way the stripper plate 74 can be oriented in any one of eight radially spaced positions about the longitudinal axis of the punch assembly 10. Thus, with the plate opening 74*b* engaging the sidewalls of the operating end 46 of the punch 45, the stripper plate 74 will not only guide the punch longitudinally but will also maintain its proper angular position (e.g., one of eight positions can be selected) about the axis of the punch by placing the orientation pin 74*c* in one of slots 76*b*.

Figure 7:
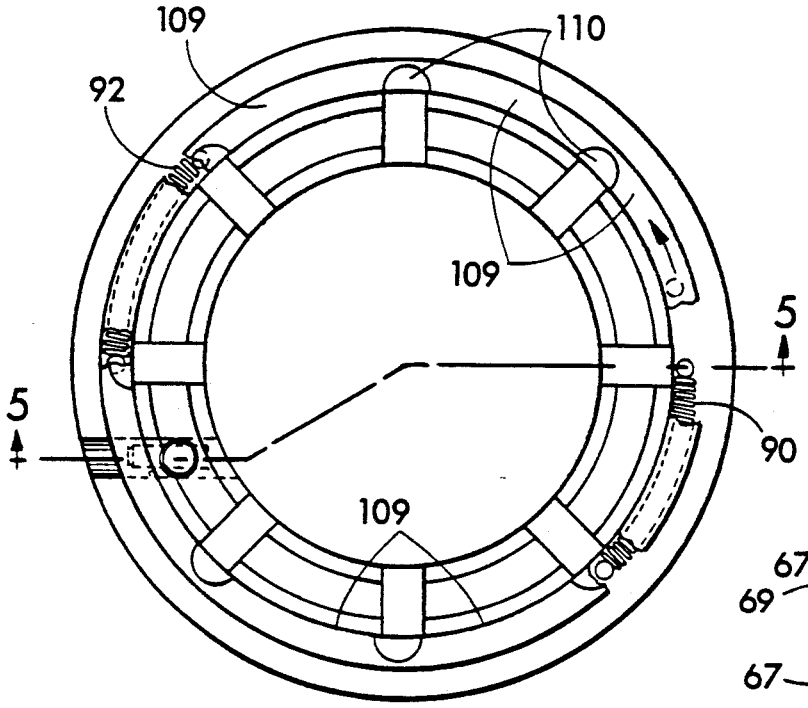
FIG. 7 is a bottom view of the punch assembly with the punch and stripper plate removed and the locking ring locked in an open position.
Figure 8:
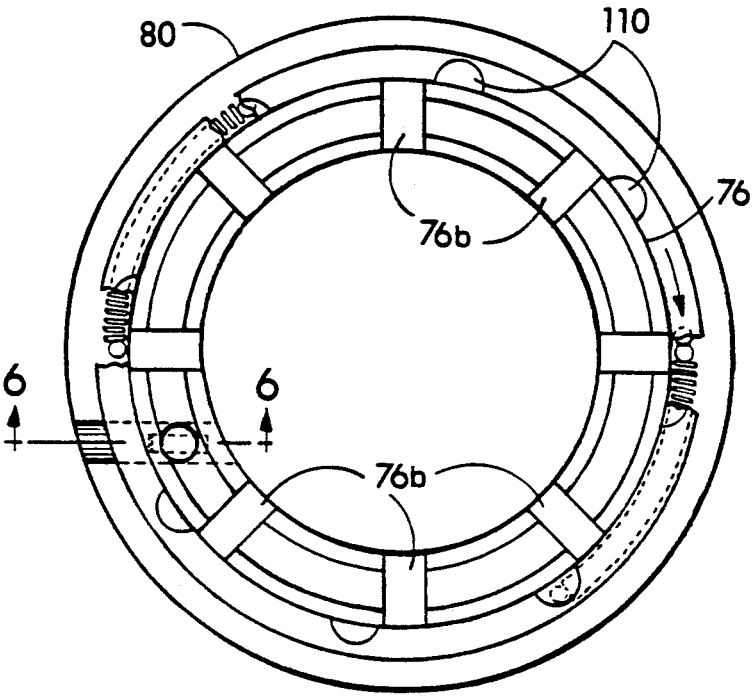
FIG. 8 is a view similar to FIG. 7 showing the locking ring in position to hold the stripper plate in place.

To hold the stripper plate in place, the locking ring 80 is undercut with centrally extending flanges 109 spaced apart by pin receiving slots 110 (FIGS. 3, 7 and 8) to cover the pins 74*d*. To remove or replace the stripper plate 74, the locking ring 80 is turned, i.e. shifted, about the axis of the punch assembly against the compression of the springs 90, 92 thereby aligning the pin receiving slots 110 with the pins 74*d* and allowing the stripper plate 74 to be removed and re-inserted. Then, by pushing the stripper in and depressing release pin 112, the springs 90, 92 rotate locking ring 80 on the boss 76 so that the flanges 109 cover the pins 74*d* thereby holding the stripper plate 74 securely in place on the end of the punch assembly 10.

Figure 5:
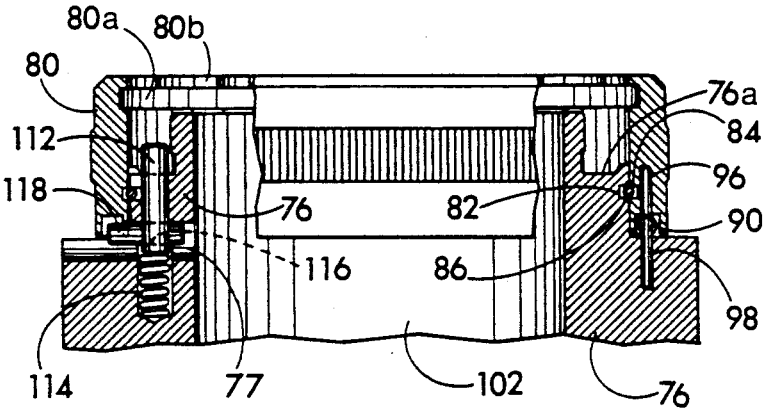
FIG. 5 is a partial cross-sectional view of the lower end of the punching assembly taken on line 5—5 of FIG. 7 with the locking ring locked in place.
Figure 6:
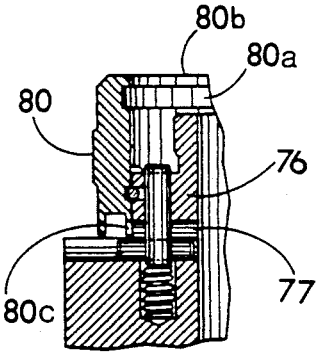
FIG. 6 is a partial view of the punching assembly as shown in FIG. 5 taken on line 6—6 of FIG. 8 with the locking ring unlocked.

The automatic stripper plate ejecting mechanism will now be described. As seen in FIGS. 5 and 6, an axially extending release pin 112 is slidably mounted in the boss 76 and is yieldably biased toward the free end of the boss by means of a helical spring 114. The release pin 112 is bored at 116 to carry a laterally extending locking pin 118. The release pin 112 is normally extended in the position shown in FIG. 5 under the influence of the helical compression spring 114. Under these circumstances the locking pin 118 is in an extended position with its outer end in a locking pin recess 80*c* (FIG. 6) in the locking ring 80. The locking pin 118 is located in a substantially larger, radially extending hole 77 at the base of the boss 76 and is free to move a short distance up and down within the hole 77. Whenever the locking ring 80 is turned in a counterclockwise direction on the boss 76 against the compression of springs 90, 92, the locking pin 118 will ultimately become aligned with the locking pin retaining slot 80*c* whereupon the spring 114 will force the release pin 112 and locking pin 118 axially of the punch, i.e. outwardly, so that the locking pin rests in the locking pin retaining slot 80*c* thereby holding the locking ring 80 temporarily in an "open" or "insert" position ready to receive the stripper plate 74.

The stripper plate can now be inserted with the orientation pin 74*c* in one of the slots 76*b*. As this is done, the rim 75 of the stripper plate 74 will strike the release pin 112, forcing it back into the boss 76 and as soon as the locking pin 118 has cleared the locking pin retaining slot 80*c*, the springs 90, 92 will quickly rotate the locking ring 80 to a locking position with the flanges 109 extending over the pins 74*d* to securely retain the stripper plate 74 in place. In this way it can be seen that the stripper plate can be very quickly and easily inserted with one hand and, upon being inserted, is automatically held in place by the automatic locking action of the locking ring 80 due to the retraction of release pin 112 and the consequent removal of the locking pin 118 from the slot 80*c*.

However, when the stripper plate 74 and punch 45 are to be removed, all that is necessary after loosening the drawbolt 56 is to again turn the locking ring 80 in a counterclockwise direction against the force of the springs 90, 92, allowing the locking pin 118 to snap up under the influence of spring 114 into the locking pin retaining slot 80*c*. As this happens the ejection spring 58 pops the punch 45 out, thereby automatically ejecting the stripper plate 74 with a snap action.

From the foregoing description it can be seen that the punch assembly 10 is self-contained. It is well suited for use in a high speed turret punch press of the type with a push-pull ram but can also be used, if desired, on a push style punch. The punch assembly 10 is supported for reciprocation in the turret bore by its outside surface and is oriented about its axis, i.e. prevented from rotating by the external key means 42. Within the punch assembly 10, the tang 12 is oriented by means of the key 68 and the operating end 46 of the punch 45 itself is oriented against both lateral motion and against turning about the axis of the punch by the stripper plate 74.

During operation of the punch press, the turret 34 is indexed conventionally so that the punch holder tang 12 enters the T-slot 16 of the ram 18. In the punching operation the ram moves downwardly, pushing the entire punch assembly 10 downwardly against the workpiece. When the stripper reaches the workpiece 40, it and the punch assembly 10 stop as the ram 18, tang 12 and punch 45 continue downwardly to pierce the workpiece 40. On the return stroke the ram 18 forcefully retracts the tang 12 and the punch 45 while the retraction springs 52 apply pressure to the workpiece via the stripper 74, holding it flat and securely in place, thereby stripping it reliably from the punch point 46.

It will also be seen that the punch 45 is guided in three locations: first, at its upper end by reason of the attachment of the tang 12 by means of the drawbolt 56, second, by means of the flange 45*a*, and third, by means of the sliding fit in the surrounding opening of the stripper plate 74. This is important because it distributes the loads more evenly throughout the punch and reduces wear, particularly when the punch is used for nibbling, an operation that produces substantial lateral stresses on the punch point. In addition, the punch is held against rotation in three ways: first, by the key 42 between the punch assembly and the turret; second, by the means of the key 68 between the tang 12 and the punch sleeve; and third, by means of the engagement between the stripper plate 74 and the punch point 46 (assuming that the punch point is other than circular in shape) or if it is circular, rotation at the free end of the punch is prevented by the engagement between the pin 45*b* and the keyway 45*c*.

It will also be noted that the action of stripping the work from the punch point 46 is accomplished by the spring 52. This achieves an effective stripping action while the position of the punch assembly itself is controlled by the ram 18.

It can also be seen that a single fastener, namely the drawbolt 56, is provided for maintaining a positive punch retention. In addition, fastener 56 is always kept in place ready for use. A further important advantage is provided in that by loosening the drawbolt 56 all the way the continued downward pressure produced by the ejection spring 58 will, when the drawbolt 56 is entirely out of the punch 45, cause the drawbolt 56 to make an audible clicking sound due to the last thread at the end of the drawbolt 56 raising the bolt repeatedly against the pressure of the ejection spring 58. This sound indicates that the punch is free and can be removed by drawing it through the lower end of the sleeve 48 after rotating the locking ring 80 to release the stripper 74.

As already described, the stripper plate is easy to remove and reinsert and the punch and stripper plate are ejected by the ejection spring 58 with a pop-out action to further facilitate rapid punch removal and replacement. The orientation pin 74*c* cooperating with the multiple slots 76*b* provides multiple position keying. In other words, the punch can be positioned in any one of eight angularly spaced apart positions about the axis of the punch to facilitate versatile use of the tooling.

Figure 9:
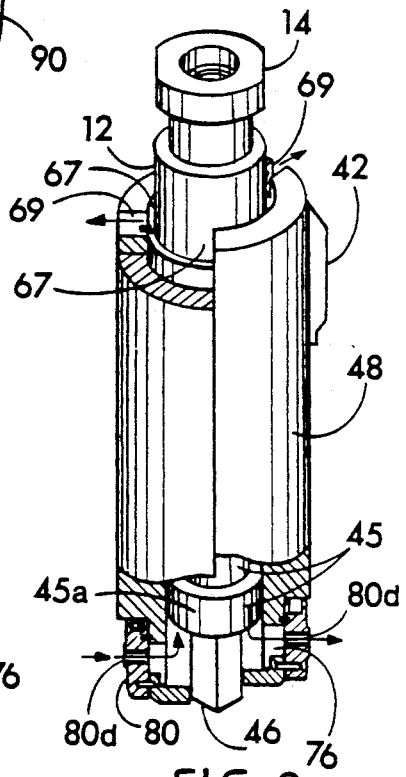
FIG. 9 is a perspective view of the punching assembly showing the flow of oil and air.

Refer now to FIG. 9. The locking ring 80 is procuring operation are aligned with the slots 76*b* so that the flange 45*a* acts as a piston or plunger in bore 71 causing the space within the bore 71 to change volume, thereby drawing air rapidly in and out through the air ports 80*d*, as best seen in FIG. 9, to provide cooling air for the punch point 46 as the chamber surrounding the punch point 46 changes volume. This helps to keep the punch point 46 cool and further lengthens its life.

Lubricating oil normally present around the ram 18 flows downwardly about the tang 12 and will flow next into an annular lubrication trough 67 which communicates with radially extending runoff slots 69 that enable a certain amount of lubrication to flow down over the outer surface of the sleeve 48 to provide ample lubrication between the punch assembly 10 and the turret bore 30. The remaining lubrication within the trough 67 will, during operation, flow downwardly through a lubrication channel such as spiral channel 13 (FIG. 2) and between the tang 12 and the bore 50 to provide lubrication at that point as well as to the retraction spring assembly 52 and the sliding engagement between the punch in the bore 71 and the punch point 46 in the stripper plate 74.

In this way the punch assembly of the present invention makes it more feasible to have all stations of the punch press filled to capacity with punches that are able to operate at high speed under either standard manual operation or computer automated control and indexing, i.e. with electronic data processing control capability.

It can also be seen that both the punch point 46 and the flange 45*a* are guided as well as the top of the punch which is guided by the tang to achieve stable, rigid and clean cutting action.

Many variations within the scope of the appended claims will be apparent to those skilled in the art once the principles described above are understood.

What is claimed is:

1. A punching assembly for a punch press or the like having an opening for the punch assembly and a ram, said punch assembly comprising, a sleeve having upper and lower ends and being adapted to be mounted for sliding movement in the opening of the press, a punch slidably mounted in the sleeve for movement along a punch axis, a stripper plate mounted at one end of the sleeve, said stripper plate having an opening corresponding in shape to the shape of the punch and being sized to provide a sliding fit for an operating end of the punch, spring means for yieldably biasing the punch toward a retracted position in the sleeve, a member at the upper end of the punch for engagement with said ram, and to enhance resistance to deterioration and improve the useful life of the tool, a means for reducing wear and distributing loading more evenly throughout the punch assembly between the punch and the sleeve and between the punch and the stripper plate whereby rework and replacement of parts is reduced, at least one projection and a retaining member contains at least one retaining element adapted to cover the projection for holding the stripper plate in place and the retaining member is shiftable to a stripper plate releasing position when the retaining element is out of alignment with the projection on the stripper plate.

2. The apparatus of claim 1 wherein the stripper plate is provided with an orientation means for orienting the stripper plate at any one of a plurality of selected angular positions about the axis of the punch.

3. The apparatus of claim 1 wherein an orientation means comprises a pin connection between the stripper plate and the punch assembly to prevent rotation of the stripper plate thereon.

4. A punching assembly for a punch press or the like having an opening for the punch assembly and a ram, said punch assembly comprising a sleeve adapted to be mounted for sliding movement in the opening of the press, a punch slidably mounted in the sleeve for movement along a punch axis, a stripper plate mounted at one end of the sleeve, said stripper plate having an opening corresponding in shape to the shape of the punch and being sized to provide a sliding fit for an operating end of the punch, spring means for yieldably biasing the punch toward a retracted position in the sleeve, means at the upper end of said punch for engagement with said ram to reciprocate the punch, said sleeve has upper and lower ends, and, to improve wear resistance and extend the useful life of the tool, means for enhancing wear resistance between the punch, the sleeve and the stripper plate whereby rework and replacement of parts id reduced, said means comprising a circular open-topped, upwardly-facing unpressurized lubricant collection trough at least partially encircling a bore in the sleeve for collecting lubricant flowing downwardly about said means at the upper end of the punch into said trough at the upper end of the sleeve and at least one lubrication channel communicating with the collection trough to carry lubrication internally of the punching assembly for lubricating the punch and said spring means whereby the punching assembly is lubricated without lubricant supplied thereto under pressure.

5. A punching assembly for a punch press or the like having an opening for the punch assembly and a ram, said punch assembly comprising, a sleeve having upper and lower ends and an exterior and being adapted to be mounted for sliding movement in the opening of the press, a punch slidably mounted in the sleeve for movement along a punch axis, a stripper plate mounted at one end of the sleeve, said stripper plate having an opening corresponding in shape to the shape of the punch and being sized to provide a sliding fit for n operating end of the punch, spring means for yieldably biasing the punch toward a retracted position in the sleeve, a tang at the upper end of the punch for engagement with said ram, and to enhance resistance to deterioration and improve the useful like of the tool, a means for reducing wear and distributing loading more evenly throughout the punch assembly between the punch and the sleeve and between the punch and the stripper plate whereby rework and replacement of parts is reduced, said means comprising a lubrication collection through surrounding a bore in the sleeve at the upper end of the sleeve, said punch assembly including at least one lubrication channel communicating with the trough to carry lubrication internally of the punching assembly for lubrication the punch and said resilient means, overflow channel means extending from the lubrication trough outwardly toward the exterior of the sleeve for carrying a portion of the lubrication from the trough to an outside surface of the sleeve for providing lubrication to said outside surface.

6. A punching assembly for a punch press or the like having an opening for the punch assembly and a ram, said punch assembly comprising, (a) a sleeve having upper and lower ends and being adapted to be mounted for sliding movement in the opening of the press, (b) a punch slidably mounted in the sleeve for movement along a punch axis therewithin, (c) a stripper plate mounted at the lower end of the sleeve, said stripper plate having an opening corresponding in shape to the shape of the punch and being sized to provide a sliding fit for an operating end of the punch, (d) spring means for yieldably biasing the punch toward a retracted position in the sleeve, (d) a tang spaced apart from the upper end of the punch for engagement with said ram, the upper end of the sleeve extending upwardly to overlap and partially enclose the tang, (f) a releasably fastener connected between the tang and the ram for securing the tang and the ram ridigly to one another, (g) spacer means located between the tang and the punch to establish said space therebetween, (h) means for reducing wear and distributing loading more evenly throughout the punch assembly between the punch and the sleeve and between the punch and the the stripper plate whereby rework and replacement of parts is reduced, (i) the means for reducing wear comprises a three-way guide means for the punch comprising:

(1) linear bearing means between the tang and the sleeve allowing the tang to slide within the sleeve, (2) a surface on the punch slidably engaging the sleeve, and (3) a sliding fit between the operating end of the punch and the stripper plate whereby said stripper plate prevents lateral deflection of an operating end of the punch to thereby reduce wear and lengthen the life of the punch.

7. A punching assembly for a punch press or the like having an opening for the punch assembly and a ram, said punch assembly comprising, a sleeve having upper and lower ends and being adapted to be mounted for sliding movement in the opening of the press, a punch slidably mounted in the sleeve for movement along a punch axis, a stripper plate mounted at one end of the sleeve, said stripper plate having an opening corresponding in shape to the shape of the punch and being sized to provide a sliding fit for an operating end of the punch, spring means for yieldably biasing the punch toward a retracted position in the sleeve, a member at the upper end of the punch for engagement with said ram, and to enhance resistance to deterioration and improve the useful like of the tool, a means for reducing wear and distributing loading more evenly throughout the punch assembly between the punch and the sleeve and between the punch and the stripper plate whereby rework and replacement of parts is reduced, a locking ring is mounted for rotation upon the sleeve adjacent to the stripper plate and the locking ring is rotatable to misalign a retaining means with respect to the stripper plate to facilitate the removal thereof.

* * * * *